US006678902B1

(12) United States Patent
Adriano

(10) Patent No.: US 6,678,902 B1
(45) Date of Patent: Jan. 20, 2004

(54) PORTABLE WASHBASIN FOR BABIES

(75) Inventor: Gabriele Adriano, Grumello del Monte (IT)

(73) Assignee: Foppa Pedretti S.p.A., Grumello del Monte (IT)

( * ) Notice: Subject to any disclaimer, the term of this patent is extended or adjusted under 35 U.S.C. 154(b) by 0 days.

(21) Appl. No.: 10/292,648

(22) Filed: Nov. 12, 2002

(51) Int. Cl.[7] ..... A47K 3/024
(52) U.S. Cl. ..... 4/572.1; 4/619; 4/446
(58) Field of Search ..... 4/572.1, 445, 625, 4/619, 638, 446, 340, 341, 650, 653; 206/823; 132/286, 312, 313, 314, 315

(56) References Cited

U.S. PATENT DOCUMENTS 1,374,778 A * 4/1921 Terry ..... 4/626
1,961,437 A * 6/1934 Tuttle et al. ..... 132/313
2,382,061 A * 8/1945 Janchick ..... 132/315
2,469,184 A * 5/1949 Thomas ..... 4/625
2,594,938 A * 4/1952 Leavitt ..... 4/626
2,614,264 A * 10/1952 Schmidt, Jr. ..... 4/572.1
2,974,322 A * 3/1961 Norris ..... 4/572.1
3,068,491 A * 12/1962 Perekrestenko ..... 4/516
3,251,637 A * 5/1966 Parsons, Jr. ..... 4/630
3,664,353 A * 5/1972 Childress, Jr. ..... 132/286
6,081,943 A * 7/2000 Garcete ..... 4/476
6,102,172 A * 8/2000 Dercole ..... 206/823

* cited by examiner

*Primary Examiner*—Gene Mancene
*Assistant Examiner*—Khoa Huynh
(74) *Attorney, Agent, or Firm*—McGlew and Tuttle, P.C.

(57) ABSTRACT

The object of the present invention is a washbasin for babies comprising a main portion shaped as a real washbasin, with a central concavity and a flat peripheral portion surrounding it, intended to serve as rest surface for the main portion on the edge of a bidet or on a special rest stand, and a portion hinged to said main portion so as to allow opening the washbasin for use and closing the washbasin for carrying it like a briefcase. On its inside wall surface, the hinged portion of the main portion is provided with means for attaching a mirror and healthcare products for the baby.

8 Claims, 2 Drawing Sheets

PORTABLE WASHBASIN FOR BABIES

FIELD OF THE INVENTION

The present finding relates to the field of health-care products, and it particularly refers to a washbasin for babies, the washbasin being especially applicable to the structure of a bidet.

BACKGROUND OF THE INVENTION

At present, to allow a small baby to wash his hands, face or teeth using the usual washbasin, an adult must pick him up, optionally using a stool. As an alternative, the baby can use the bidet or the bathtub as washbasin, with obvious hygienic drawbacks.

SUMMARY OF THE INVENTION

An object of the present finding is to obviate the above disadvantages and to allow babies to have a real washbasin suitable for their anthropometrical sizes.

Another object of the finding is to provide a small plastic washbasin which uses the tap and the sink of any bidet while being hygienically isolated from its structure.

These and other objects of the finding are achieved by a washbasin for babies comprising a main portion shaped as a real washbasin, having a central concavity and a flat peripheral portion surrounding it and intended to serve as rest surface for said main portion on the edge of a bidet or on a special rest, and a second portion hinged to said main portion so as to allow opening the washbasin for use and closing the washbasin for carrying it as a briefcase.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
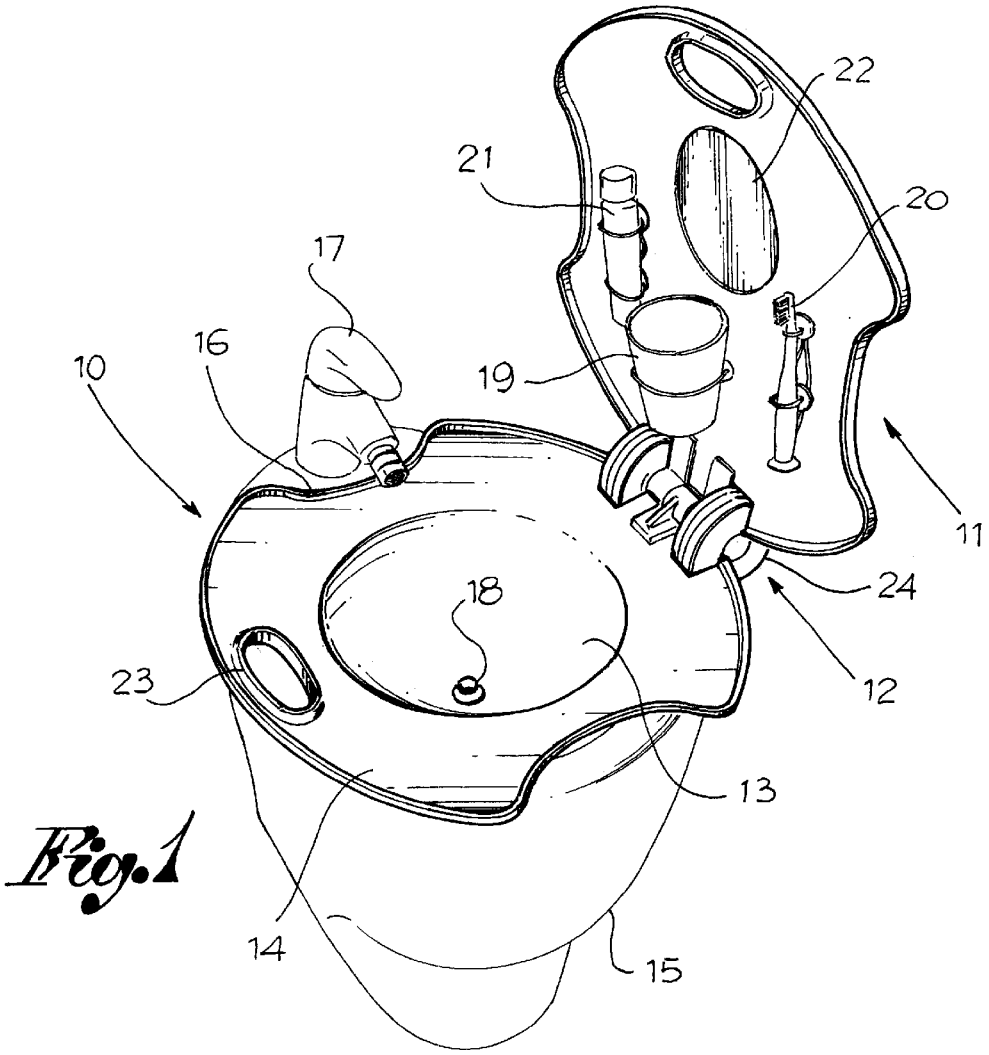
FIG. 1 shows a perspective view of the washbasin arranged on a bidet for use.
Figure 3:
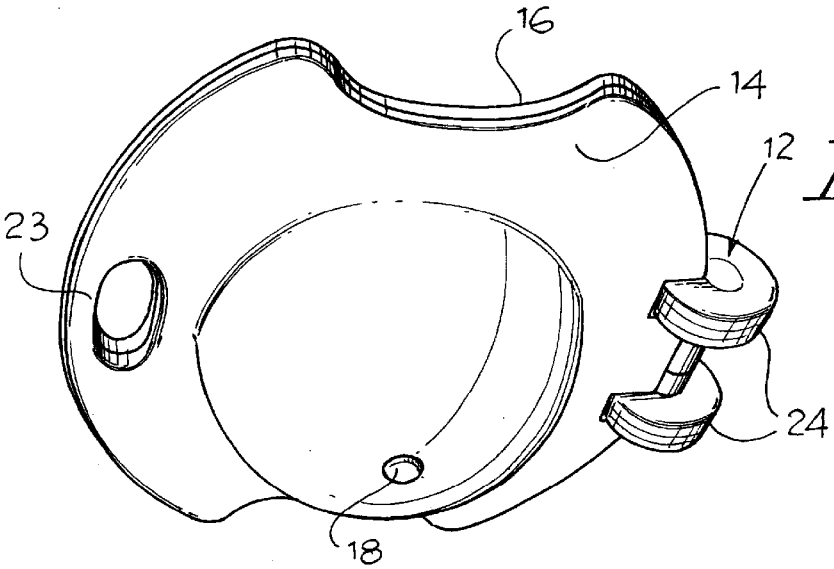
FIG. 3 shows the closed washbasin ready for carriage.

Referring to the drawings in particular the washbasin under discussion consists of two portions 10 and 11 reciprocally hinged by hinge 12 so as to be openable and closable with respect to each other as a briefcase. One of the two portions, here indicated with reference numeral 10, exhibits the structure of a small washbasin, that is a central concavity 13 surrounded by a substantially flat peripheral edge 14. Said edge 14 is intended to be firmly rested on the edge of any bidet 15. To this purpose, edge 14 of the washbasin exhibits at least one recess 16 at the tap 17 of the bidet. In addition, at the bottom of the central concavity 17 there is provided a hole 18, closable by a relevant plug, to allow the water put into the washbasin by the bidet tap to flow into the bidet itself and thereby use its sink.

Portion 11 serves as cover for portion 10 when the washbasin is not used, whereas with the washbasin open, it serves as wall, carrying on its inside surface facing the washbasin, means for attaching a glass 19, a toothbrush 20, a toothpaste 21, a mirror 22 or other products for the baby's healthcare. When the washbasin is arranged on the bidet and is in the open position for use, portion 11 stops in a substantially vertical position. Moreover, at least one of the two portions 10, 11 of the washbasin is provided with a handle 23 for carrying the washbasin when closed. Finally, at hinge 12 the washbasin may be provided with a pair of wheels 24, so the washbasin may be easily pulled.

Figure 2:
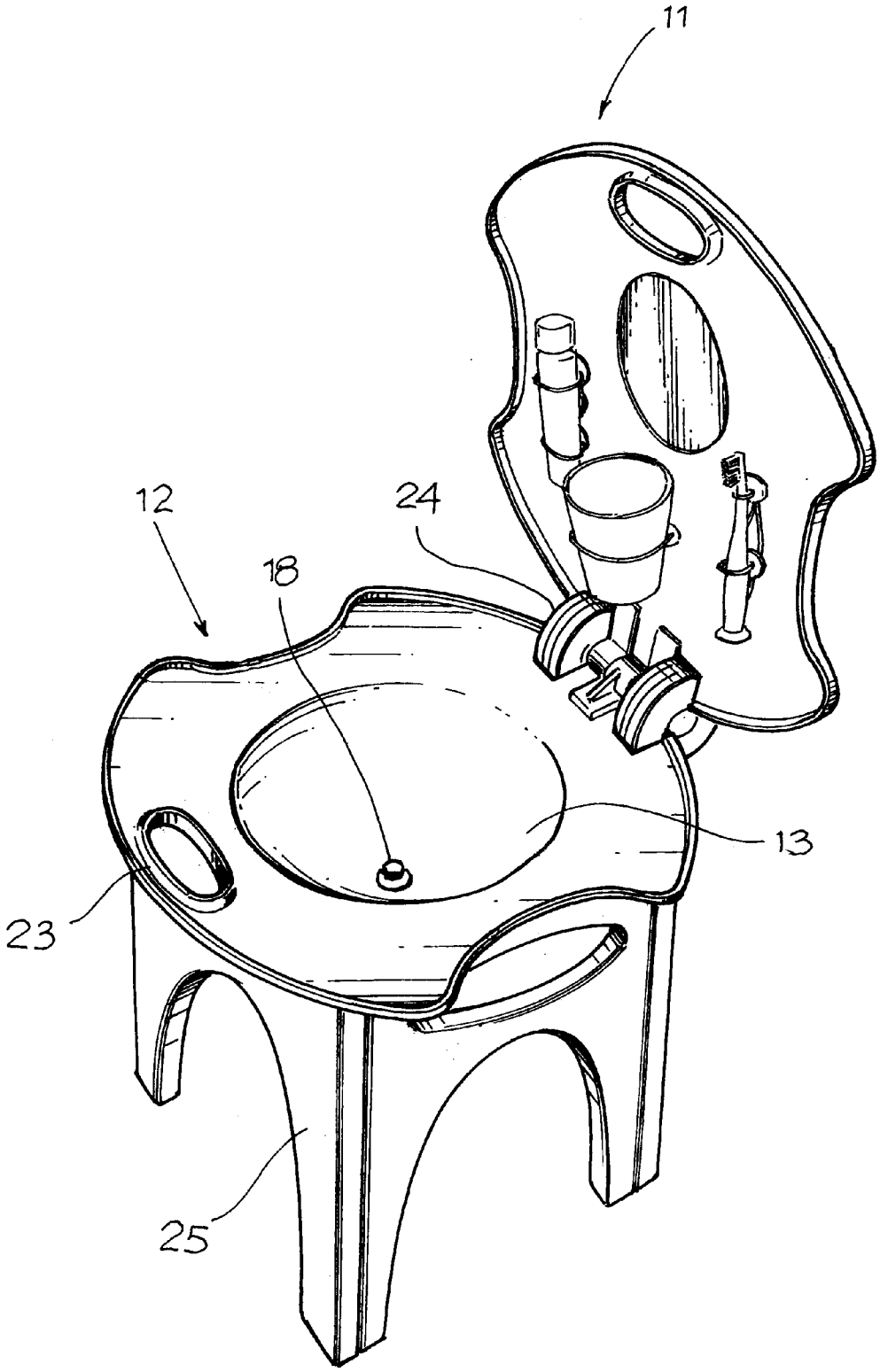
FIG. 2 shows the same washbasin arranged on a special rest.

In FIG. 2, the washbasin is arranged on a special rest 25 rather than on a bidet, which allows its use anywhere by simply putting a desired amount of water therein.

Such a washbasin is therefore easily usable by babies thanks to the height at which it is arranged, and it may serve as a real washbasin as it can use the structure, the tap and the sink of any bidet. In any case the best hygienic conditions of use are ensured since during use, the baby does not touch the structure of the sanitary fixture onto which the washbasin is arranged.

Moreover, thanks to its briefcase shape and to its light weight, the washbasin can be easily opened, closed, carried and rested on a bidet or on the relevant rest directly by the baby himself While specific embodiments of the invention have been shown and described in detail to illustrate the application of the principles of the invention, it will be understood that the invention may be embodied otherwise without departing from such principles.

What is claimed is:

1. A washbasin for babies, comprising:

a main portion shaped as a washbasin, with a central concavity with a shape for being received in a bidet and with a shape for being received in a rest stand and a flat peripheral portion surrounding said main portion, said peripheral portion being sized relative to said main portion to rest on an edge of the bidet or on the special rest stand;

a cover portion hinged to said main portion by a hinge, so as to allow an uncovering of the washbasin for use and a covering of the washbasin for non use;

at least one wheel fitted at said hinge; and a handle at an opposed side of the washbasin from said hinge for pulling the washbasin when said cover portion is closed.

2. A washbasin for babies according to claim 1, wherein said flat peripheral edge of said main portion of the washbasin exhibits at least one recess for accepting a tap of the bidet onto which the washbasin may be arranged, and wherein at a bottom of said concavity there is a hole for drain of water from the washbasin to the bidet.

3. A washbasin for babies according to claim 2, wherein on an inside surface of said cover portion, said cover portion is provided with means for attaching a mirror and healthcare products for the baby, said hinged cover portion stopping in a substantially vertical position when the washbasin is open for use.

4. A washbasin for babies according to claim 1, wherein on an inside surface of said cover portion, said cover portion is provided with means for attaching a mirror and healthcare products for the baby, sad hinged cover portion stopping in a substantially vertical position when the washbasin is open for use.

5. A washbasin and rest stand combination for babies for use with a bidet having a defined open with a concave portion surrounded by an edge, the combination comprising:

a rest stand having a defined opening with an edge, the opening having substantially the same dimensions as the bidet opening and having an edge support;

a washbasin assembly with a main portion shaped with a central concavity dimensioned to be smaller than or complementary to the bidet concave portion to received in a bidet opening and being having a shape and being dimensioned for being received in said rest stand and having a flat peripheral portion surrounding said main portion, said peripheral portion being sized relative to said main portion to rest on the edge of the bidet and being sized to rest on said edge of said rest stand, a hinge, a cover portion connected to said main portion by said hinge, so as to allow an uncovering of the washbasin for use and a covering of the washbasin for non use, wheels fitted at said hinge and a handle at an opposed side of the washbasin from said hinge for pulling the washbasin when said cover portion is closed, said handle being defined by an opening in said cover and an opening in said peripheral portion which align with said cover portion covering said washbasin.

6. A combination according to claim 5, wherein said flat peripheral edge of said main portion of the washbasin defines a recess for accepting a tap of the bidet onto which the washbasin may be arranged, and wherein at a bottom of said concavity there is a hole for draining of water from the washbasin to the bidet.

7. A washbasin for babies according to claim 6, wherein on an inside surface of said cover portion, said cover portion is provided with means for attaching a mirror and healthcare products for the baby, said hinged cover portion stopping in a substantially vertical position when the washbasin is open for use.

8. A washbasin for babies according to claim 4, wherein on an inside surface of said cover portion, said cover portion is provided with means for attaching a mirror and healthcare products for the baby, said hinged cover portion stopping in a substantially vertical position when the washbasin is open for use.

* * * * *